US010024108B2

(12) United States Patent
Gylling

(10) Patent No.: US 10,024,108 B2
(45) Date of Patent: Jul. 17, 2018

(54) DRILLING DEVICE

(71) Applicant: OY EPIROC DRILLING TOOLS AB, Tampere (FI)

(72) Inventor: Kai Gylling, Tampere (FI)

(73) Assignee: OY EPIROC DRILLING TOOLS AB, Tampere (FI)

( * ) Notice: Subject to any disclaimer, the term of this patent is extended or adjusted under 35 U.S.C. 154(b) by 68 days.

(21) Appl. No.: 15/030,461

(22) PCT Filed: Jul. 2, 2014

(86) PCT No.: PCT/FI2014/050546
§ 371 (c)(1),
(2) Date: Apr. 19, 2016

(87) PCT Pub. No.: WO2015/059347
PCT Pub. Date: Apr. 30, 2015

(65) Prior Publication Data

US 2016/0281435 A1 Sep. 29, 2016

(30) Foreign Application Priority Data

Oct. 22, 2013 (FI) ..... 20136041

(51) Int. Cl.
*E21B 10/32* (2006.01)
*E21B 10/633* (2006.01)
(Continued)

(52) U.S. Cl.
CPC ..... *E21B 10/32* (2013.01); *E21B 10/633* (2013.01); *E21B 7/20* (2013.01); *E21B 10/36* (2013.01); *E21B 10/42* (2013.01); *E21B 10/64* (2013.01)

(58) Field of Classification Search
CPC ..... E21B 10/32; E21B 10/633
See application file for complete search history.

(56) References Cited

U.S. PATENT DOCUMENTS 3,365,010 A 1/1968 Howell et al.
4,440,244 A 4/1984 Wredal
(Continued)

FOREIGN PATENT DOCUMENTS

CH 622312 A5 3/1981
FI 75650 B 3/1988
(Continued)

OTHER PUBLICATIONS

Supplementary Search Report issued in counterpart EP Patent Application No. 14856522.9, dated May 31, 2017.
(Continued)

*Primary Examiner* — Giovanna C. Wright
*Assistant Examiner* — Kristyn A Hall
(74) *Attorney, Agent, or Firm* — Venable LLP; Jeffri A. Kaminski

(57) ABSTRACT

A drilling device for a down-the-hole drilling apparatus. The drilling device includes in a guide, a drilling member and a flushing mechanism configured to flush drilling waste. The drilling mechanism includes first and second drilling bit arrangements that are movable with respect to the drilling device and that are arranged to be expanded to drill a hole having a greater cross-sectional surface area than an end of the casing and arranged to be reduced to a size smaller than the end of the casing. Bit pieces of the second drill bit arrangement expand and reduce the second drill bit arrangement. The bit pieces expand the second drill bit arrangement by moving in a radial direction outwards in slide grooves, by rotating the guide in a drilling direction, and move in the radial direction inwards in the slide grooves, by rotating the guide in an opposite direction.

10 Claims, 5 Drawing Sheets

(51) Int. Cl.

| | |
|---|---|
| *E21B 7/20* | (2006.01) |
| *E21B 10/36* | (2006.01) |
| *E21B 10/42* | (2006.01) |
| *E21B 10/64* | (2006.01) |

(56) References Cited

U.S. PATENT DOCUMENTS

| | | | |
|---|---|---|---|
| 5,139,099 | A | 8/1992 | Hayashi et al. |
| 5,361,859 | A | 11/1994 | Tibbitts |
| 5,957,226 | A | 9/1999 | Holte |
| 2009/0188719 | A1 | 7/2009 | Lim |
| 2010/0236831 | A1 | 9/2010 | Nakamura |
| 2011/0073376 | A1 | 3/2011 | Radford et al. |

FOREIGN PATENT DOCUMENTS

| | | | |
|---|---|---|---|
| FI | 94891 | B | 7/1995 |
| GB | 973790 | | 10/1964 |
| GB | 2310229 | A | 8/1997 |
| JP | 3322484 | | 6/2002 |

OTHER PUBLICATIONS

PCT/ISA/210—International Search Report—Feb. 27, 2015 (Issued in Application No. PCT/FI2014/050546).

PCT/ISA/237—Written Opinion of the International Searching Authority—Feb. 27, 2015 (Issued in Application No. PCT/FI2014/050546).

PCT/IPEA/409—International Preliminary Report on Patentability—Feb. 3, 2015 (Issued in Application No. PCT/FI2014/050546).

DRILLING DEVICE

CROSS REFERENCE TO RELATED APPLICATIONS

This application claims priority to Finnish patent application 20136041 filed 22 Oct. 2013 and is the national phase under 35 U.S.C. § 371 of PCT/FI2014/050546 filed 2 Jul. 2014.

FIELD OF THE INVENTION

The invention relates to a drilling device that is meant to be used in a down-the-hole drilling apparatus for drilling a hole by using the drilling device and a casing part as well as a hammering device when needed. The drilling device comprises in a drilling head thereof a guide, drilling means as well as advantageously flushing means for flushing of drilling waste being generated. The drilling means comprise a first drill bit arrangement and a second drill bit arrangement that is movable with respect to the above, whereby the drill bit arrangements are provided with drilling organs, such as an integrated drilling part, separate drilling pieces, bits or the like. The second drill bit arrangement is arranged on the one hand to be expanded for drilling a greater hole than a free cross-sectional surface area of an end of the casing part and on the other hand to be reduced to a smaller size than the free cross-sectional surface area of the end of the casing part in order to make possible removal of the drilling device from a hole that has been drilled and for leaving the casing part in the drilled hole by removing the drilling device through the casing part from above. The second drill bit arrangement is arranged by two or more bit pieces that are movable in radial direction on the drilling surface of the drilling means, and in which the drilling organs are arranged when viewed in longitudinal direction of the drilling device on the front surface thereof.

BACKGROUND OF THE INVENTION

The type of drilling apparatuses described above have been used for a long time and for example in patent publication FI 75650 there has been presented a boring tool, which is meant for boring and/or hammer drilling, to be used in connection with a drill rod unit placed inside a core pipe. The boring tool to be attached at the front end of the drill rod unit has a center being provided with a cutting unit, and an eccentric reaming drill, being placed behind the center drill, the reaming drill having also a cutting unit. The reaming drill moves with respect to the center drill between a drilling position, in which it is positioned to the side in front of the core pipe, and a return position, in which it is withdrawn in radial direction inside the core pipe. Deviating from earlier solutions, in which the center drill is in most cases provided with four cutting parts directed radially and being made of hard metal, the reamer for its part comprising either one or two radially directed cutting parts made of hard metal, in the solution according to the publication in question, the cutting parts are replaced by bit parts being arranged in a certain manner. With the solution presented in the publication in question such constructions of the center drill and the reaming drill have been, desired that the operating time of the boring tool will be as long as possible.

It is thus characteristic for use of the type of drilling apparatuses described above that the hole to be drilled to the ground is reamed by an eccentrically operating reaming drill. This leads to most differing kinds of problems. First of all the drilling motion of the reaming drill taking place eccentrically causes high torsion stress to the drill rod unit. In this case it is not possible to take optimally advantage of the operating efficiency of the drilling device due to high breakage risk of the drill rod unit, particularly breaking off thereof. On the other hand, a problem in practice in a drilling situation is often the returning of the reaming drill to its return position, which is due to ground substance, being collected between the reaming drill and the center drill. In order to get the reaming drill back to its return position, usually a repeated back and forth movement of the drilling device is required. Naturally when e.g. a too high operating power is being used or when the materials of the drilling device parts have a lowered fatigue resistance, there is a high risk for breakage of the drill rod unit.

On the other hand e.g. in Finnish patent number 94891 there has been presented a boring tool, which has two or three blocks moving in respect with each other in the same plane, the blocks forming a drill bit of the boring tool. The boring tool in question is usable as described above in a way that in a drilling situation the bit blocks are in an ejected position, in which case the bit parts placed therein drill a hole that is essentially larger than the casing part. After a drilling situation the casing part may be left in the hole and the drill rod unit inside the same with its bit blocks can be removed as a whole from the hole by moving the bit blocks with respect to each other in a way that they get withdrawn to a form that is smaller than the free internal diameter of the casing part. In the solution in question, the bit blocks are arranged movable in respect with each other by coupling each one thereof by a single guiding pin with a guide part supporting the bit blocks, which pins depending on the rotation direction of the guide part bring about protrusion of the bit blocks or the same getting together in cooperation with guide grooves in the guide part. In the patent in question several differing solutions have been presented in order to couple these guiding pins with the bit blocks. The biggest problem in practice of these types of solutions is, however, the high stresses directed to the guiding pins, in which case particularly when drilling stony ground, the durability of the guide pins is put to a tough test, because very high torsion stresses as well as torque loads are directed to the guiding pins. This is why the functionality of the guiding pins particularly in drilling to be performed under demanding circumstances is very unreliable, because when drilling e.g. rock a continuous fatigue load is directed to the pins, which furthermore weakens tensile properties thereof in longer lasting use.

Furthermore for example from patent documents CH 622312, U.S. Pat. No. 5,361,859, U.S. Pat. No. 3,365,010, GB 2310229 and GB 973790 it is known that the second drill bit arrangement is arranged by two or more bit pieces that are movable in radial direction in slide grooves that pass wide open on the drilling surface of the drilling means, and, in which the drilling organs are arranged when viewed in longitudinal direction of the drilling device on the front surface thereof. It is common to all of the solutions described above that the slide grooves therein, being inclined towards the drilling head of the drilling device when viewed in a longitudinal cross section, whereby the said bit pieces are arranged movable in the slide grooves e.g. by influence of a flushing medium being used in the drilling or by influence of a force directed thereto when the drilling head of the drilling device is being pushed against the ground. The return movement of the bit pieces in question for reducing the drilling head is carried out e.g. by spring force or by gravitation when the drilling head is being lifted upwards inside the casing part. With the type of solutions in question it is not in practice possible to e.g. lift the casing part upwards in a drilled hole, which is necessary in certain occasions.

A problem of the type of drilling heads described above is the very strongly conical drilling surfaces, which is why wearing out of the bits takes place unevenly, whereby a part of the drill bits wear out prematurely. On the other hand a further difficult problem in practice related to the type of implementations in question is the fact that by the solutions utilized therein returning of the bit pieces to the reduced position of the drilling head is practically uncertain, and is not even possible under all circumstances, which is why the drilling head can necessarily not be removed from a drilled hole without getting broken. In addition, the type of drilling device in question may "get stuck", which requires reciprocating use in order to get the drill bit released, which causes the same problems that have been explained above about the use of eccentrical drills. Due to the above, with the types of implementations in question, it is not possible to carry out drilling in practice in an adequately reliable and long-lasting manner.

SUMMARY OF THE INVENTION

The drilling device according the present invention is aimed to achieve a decisive improvement in the problems described above and thus to raise substantially the level of prior art. To bring about this aim, the drilling device according to the invention is primarily characterized by that, the bit pieces of the second drill bit arrangement are arranged, for expanding/reducing of the second drill bit arrangement by means of the guide, movable in slide grooves that pass wide open in the radial direction on the drilling surface of the drilling means for expanding the second drill bit arrangement by moving its bit pieces in the radial direction outwards in the slide grooves, by rotating the guide in one direction in a drilling direction, and for reducing the second drill bit arrangement by moving its bit pieces in the radial direction inwards in the slide grooves, by rotating the guide in an opposite direction.

As the most important advantages of the drilling device, simplicity and operating reliability of its functioning and construction may be mentioned. Thanks to the invention both in drilling and in all operations related thereto it is possible to utilize the operating efficiency of a drilling apparatus optimally, because the bit pieces of the second drill bit arrangement of the drilling means are arranged movable from an expanded drilling position to a reduced position and vice versa in radially directed slide grooves on the drilling surface first of all by influence of the rotation movement of the guide and on the other hand by a "forced control" achieved by a movement mechanism controlling the movement of the bit pieces. The slide grooves mentioned above are carried out furthermore advantageously e.g. by a so called dovetile or t-groove in a way that movement of the drill pieces in other directions is totally prevented.

Furthermore when using advantageously several bit pieces moving in slide grooves that are in radial direction symmetrically on the outer surface of the drilling unit, the risk for breakage of the drilling device is low also thanks to the fact that a significantly lower fatigue stress is directed thereto due to drilling when compared to utilization of solutions based on one single drill bit or in other ways asymmetrical solutions. In this case, there is neither a need to support the back part of the drilling device the way that is required in present solutions by a disproportionately long support surface inside the casing part, in which case also a slide surface arrangement between the back part of the drilling device and the internal surface of the casing part can be made as short as possible. Thus, the overall cost effectiveness of the drilling device according to the invention is based also on the fact that the structure of the drilling device's back part may be carried out clearly lighter than the same of the corresponding present solutions. What is the most important, is the fact that the drilling device according to the invention also makes possible removal of the drilling device from inside the casing part as a whole with its movable parts as one single piece from above, in which case there is no need to leave anything extra in addition to the casing part or the core pipe in the hole that has been drilled. The above has naturally a remarkable cost savings effect.

BRIEF DESCRIPTION OF THE DRAWINGS

Advantageous embodiments of the drilling device according to the invention have been presented herein.

In the following description the invention is being described in detail with reference to the appended drawings, in which in FIGS. 1*a* and 1*b*
is shown an advantageous drilling device according to the invention in its drilling position as a longitudinal cross section and as an end view,
in FIGS. 2*a* and 2*b*
is shown as perspective views an auxiliary frame and a drill bit of a drilling device according to FIGS. 1*a*, 1*b*,
in FIGS. 3*a* and 3*b*
is shown an advantageous alternative implementation of the drilling device according to the invention in its drilling position as a longitudinal cross section and as an end view,
in FIGS. 4*a* and 4*h*
is shown as perspective views an intermediate frame as seen from opposite directions belonging to a drilling device as shown in FIGS. 3*a* and 3*b*, and
in FIGS. 5*a* and 5*b*
are shown as advantageous embodiments perspective views of an end surface of the guide and a drill bit belonging to the drilling device according to FIGS. 3*a* and 3*b*.

DETAILED DESCRIPTION OF EMBODIMENTS OF THE INVENTION

Figure 1B:
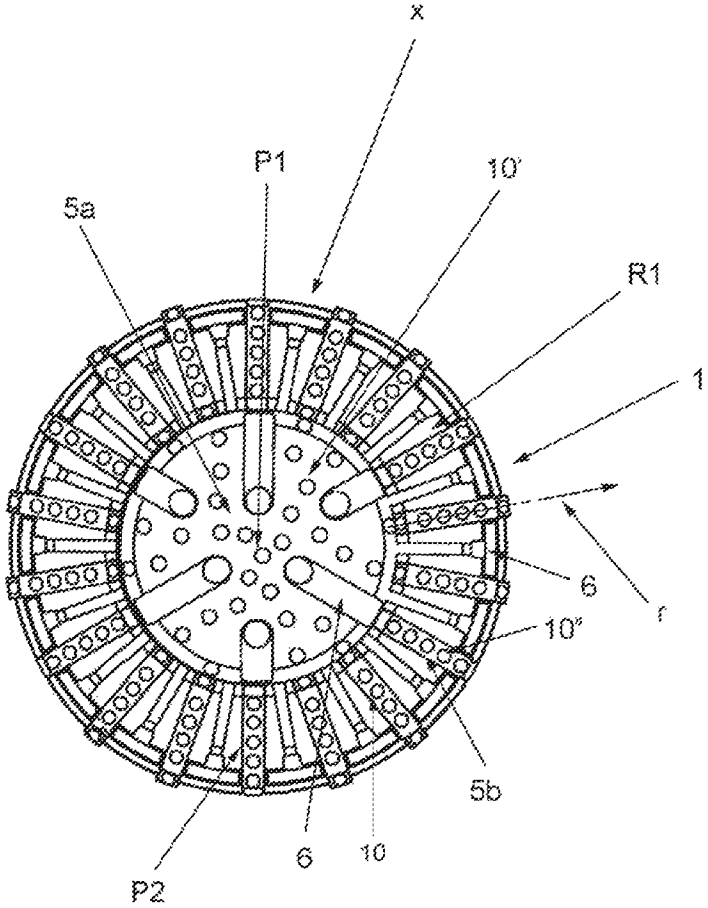

The invention relates to a drilling device that is meant to be used in a down-the-hole drilling apparatus for drilling a hole by using the drilling device 1 and a casing part 2 as well as a hammering device when needed. The drilling device 1 comprises in the drilling head I thereof a guide 4, drilling means 5 as well as advantageously flushing means for flushing of drilling waste being generated. The drilling means 5 comprise a first drill bit arrangement 5*a* and a second drill bit arrangement 5*b* that is movable with respect to the above, whereby the drill bit arrangements are provided with drilling organs 10, such as an integrated drilling part, separate drilling pieces, bits or the like. The second drill bit arrangement is arranged on the one hand to be expanded for drilling a greater t hole than a free cross-sectional surface area of an end I' of the casing part 2 and on the other hand to be reduced to a smaller size than the free cross-sectional surface area of the end I' of the casing part in order to make possible removal of the drilling device from a hole that has been drilled and for leaving the casing part 2 in the drilled hole by removing the drilling device 1 through the casing part 2 from above. The second drill bit arrangement 5*b* is arranged by two or more bit pieces that are movable in radial direction r on a drilling surface P of the drilling means, and in which the drilling organs 10; 10" are arranged when viewed in a longitudinal direction s of the drilling device on the front surface thereof.

The bit pieces 5*b*1, being advantageously essentially elongated that is essentially longer than the width of the slide grooves U and belonging to the second drill bit arrangement 5*b*, are arranged, for expanding/reducing of the second drill bit arrangement 5*b* by means of the guide 4, movable in slide grooves U that pass wide open in the radial direction r on the drilling surface P of the drilling means 5 for expanding the second drill bit arrangement 5*b* by moving its bit pieces 5*b*1 in the radial direction r outwards in the slide grooves U, by rotating the guide 4 in one direction w in a drilling direction, and for reducing the second drill bit arrangement 5*b* by moving its bit pieces 5*b*1 in the radial direction inwards in the slide grooves U, by rotating the guide 4 in an opposite direction.

Figure 1A:
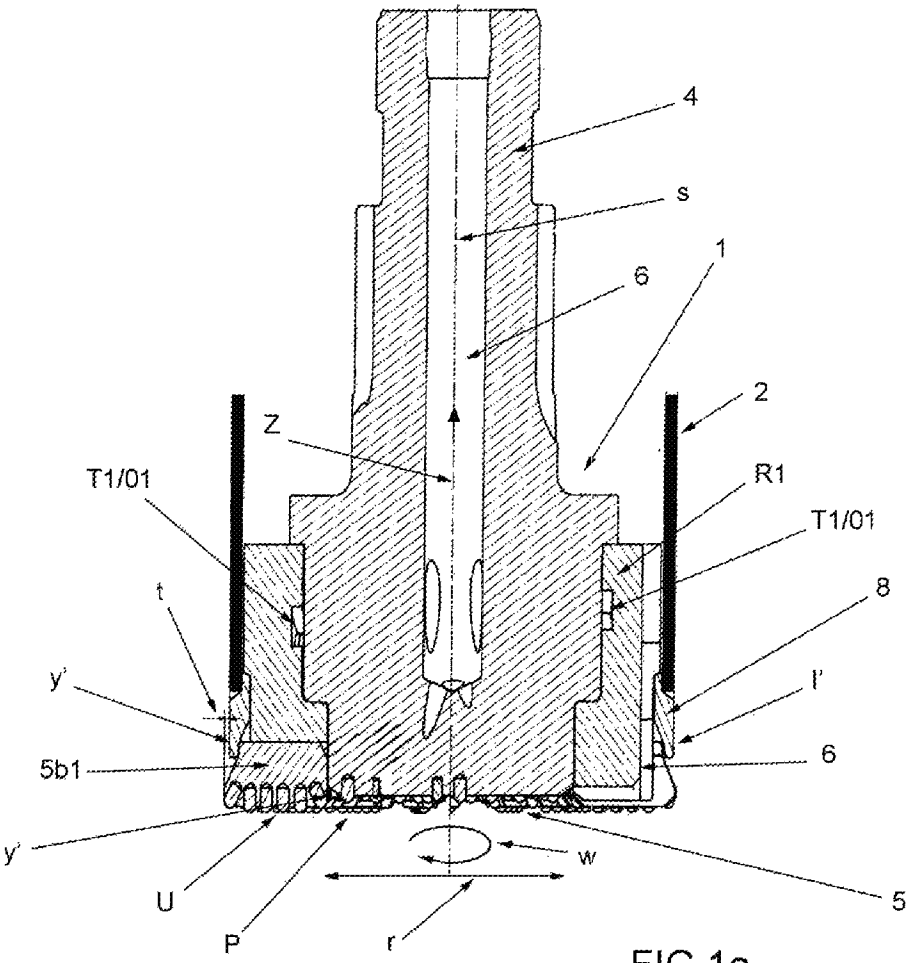

As an advantageous embodiment of the drilling device according to the invention particularly with reference to FIGS. 1*a*, 1*b*, the first drill bit arrangement 5*a* is arranged in an immovable manner in connection with the guide 4, whereby as a furthermore advantageous embodiment, the drilling organs 10 of the first drill bit arrangement 5*a*, being arranged in a built-in manner in the guide 4, are arranged at an outer end of the guide 4 operating as the drilling surface P1.

Figure 2B:
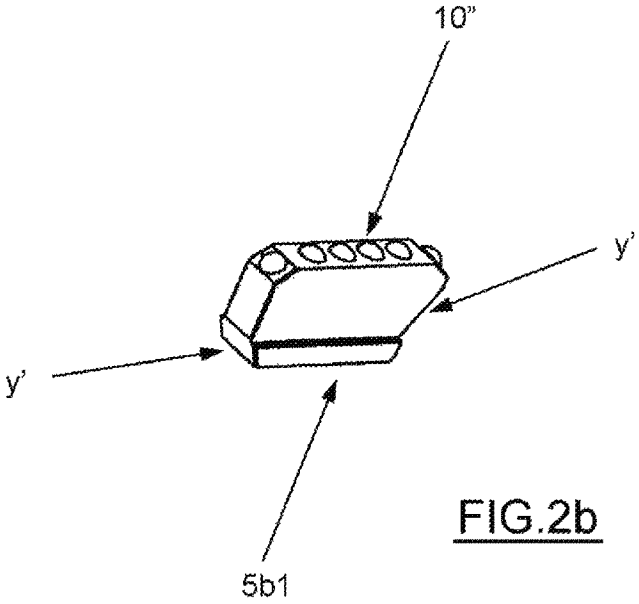
Figure 2A:
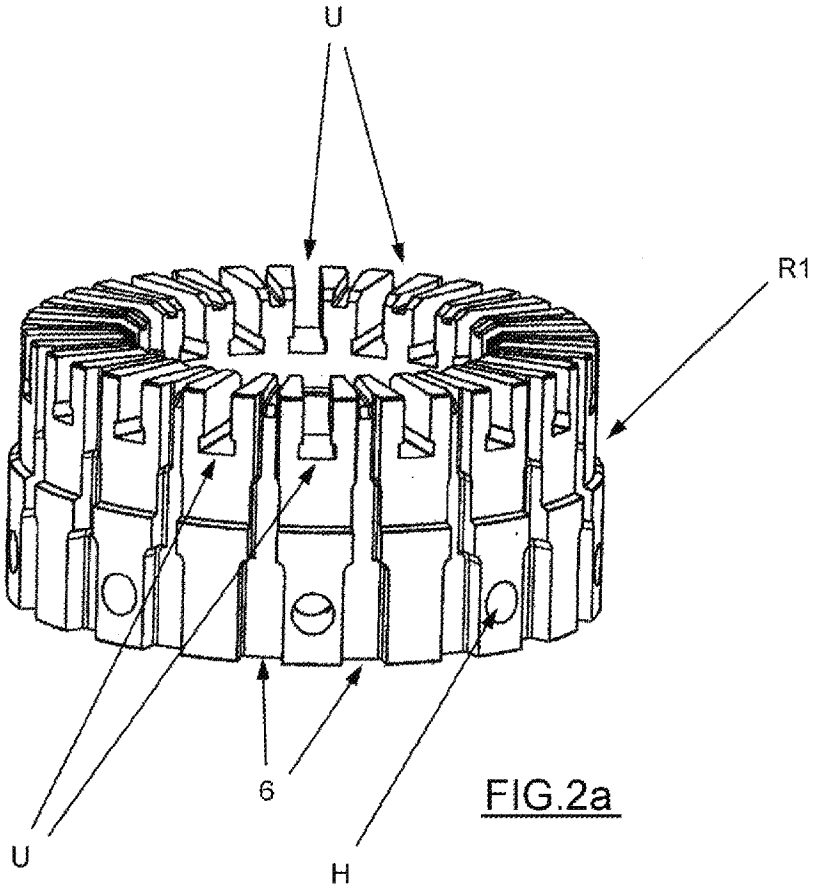

As a furthermore advantageous embodiment of this drilling device, the slide grooves U of the bit pieces 5*b*1 of the second drill bit arrangement 5*b* are arranged in an auxiliary frame R1 according to FIG. 2*a*, which is coupled with the guide 4 on the principle that manifests itself in FIG. 1*a* to rotate in a restricted manner in a crosswise plane x, such as by a pin/guide groove arrangement T1/01 or a like.

Furthermore as an advantageous embodiment of the drilling device according to FIGS. 1*a*, 1*b*, a movement mechanism of the bit pieces 5*b*1 of the second drill bit arrangement, moving in the radial direction r in a crosswise plane x that is essentially perpendicular to the longitudinal direction s of the drilling device, is arranged depending on the rotation direction of the guide 4 to push the guide in the longitudinal direction s out from the casing part 2 or to pull the same inside the casing part 2, whereby the movements of the bit pieces in the radial direction r are arranged by influence of a guide surface arrangement y', being in connection with the bit pieces and both the casing part 2 and an end of the guide 4.

The guide surface arrangement y' mentioned above comprises for example in the embodiment according to FIG. 1*a* an edge gasket at the outer edge of the guide 4 as well as e.g. according to FIG. 2*b* inclined guide surfaces at the opposite ends of the bit pieces 5*b*1, which glide against an internal guide surface of the casing shoe 8 existing at the end of the casing part 2, when the guide 4 moves in the longitudinal direction s inside the casing part 2 as explained in the following.

The embodiment according to FIGS. 1*a*, 1*b* is carried out furthermore advantageously in a way that the bits 10' at the end of the guide 4 are positioned in the longitudinal direction s to some extent deeper than the bits 10" of the second drill bit arrangement 5*b*, which has been found in practice to operate more profitably in drilling in some occasions than by placing the bits in totally the same plane. According to FIGS. 1*a* and 2*b*, the bits 10" at opposite ends of the bit pieces 5*b*1 are placed advantageously on inclined surfaces and so that the bits at the "reaming end" of the bit pieces are arranged to ream the drill being drilled according to FIG. 1 with an adequate clearance t with respect to the outer diameter of the casing shoe 8 at the end of the casing part 2.

As a furthermore advantageous embodiment of the drilling device according to the invention, movement z of the guide 4 in the longitudinal direction s while the same is being rotated in an opposite direction with respect to the drilling rotation direction w, is arranged by a thread coupling carried out by a pin/guide groove arrangement T1/01 or a like between the guide 4 and the auxiliary frame R1, in which case the auxiliary frame has one or more thread grooves and the guide 4 has respectively one or more draw pins. The thread coupling in question, which is carried out advantageously by using draw pins to be installed in holes H in the auxiliary frame R1 after installation of the guide 4 and the auxiliary frame R1 on top of each other, works in practice in a drilling situation also as a power transmission arrangement transmitting the guide's 4 rotational motion to the auxiliary frame R1.

Figure 3B:
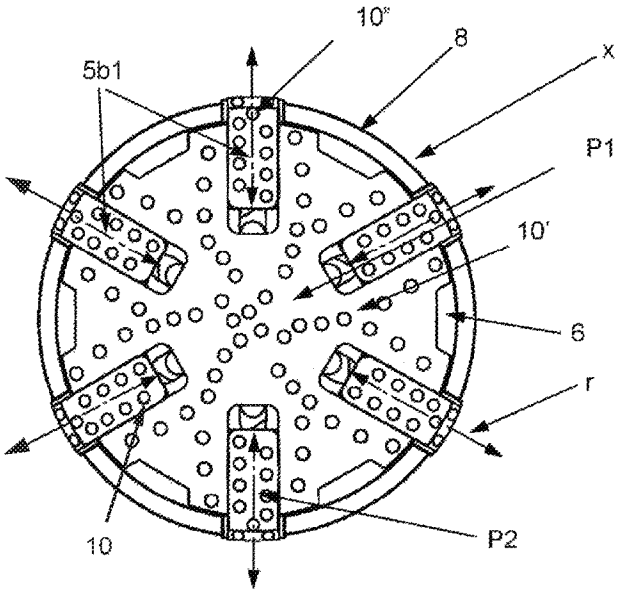
Figure 3A:
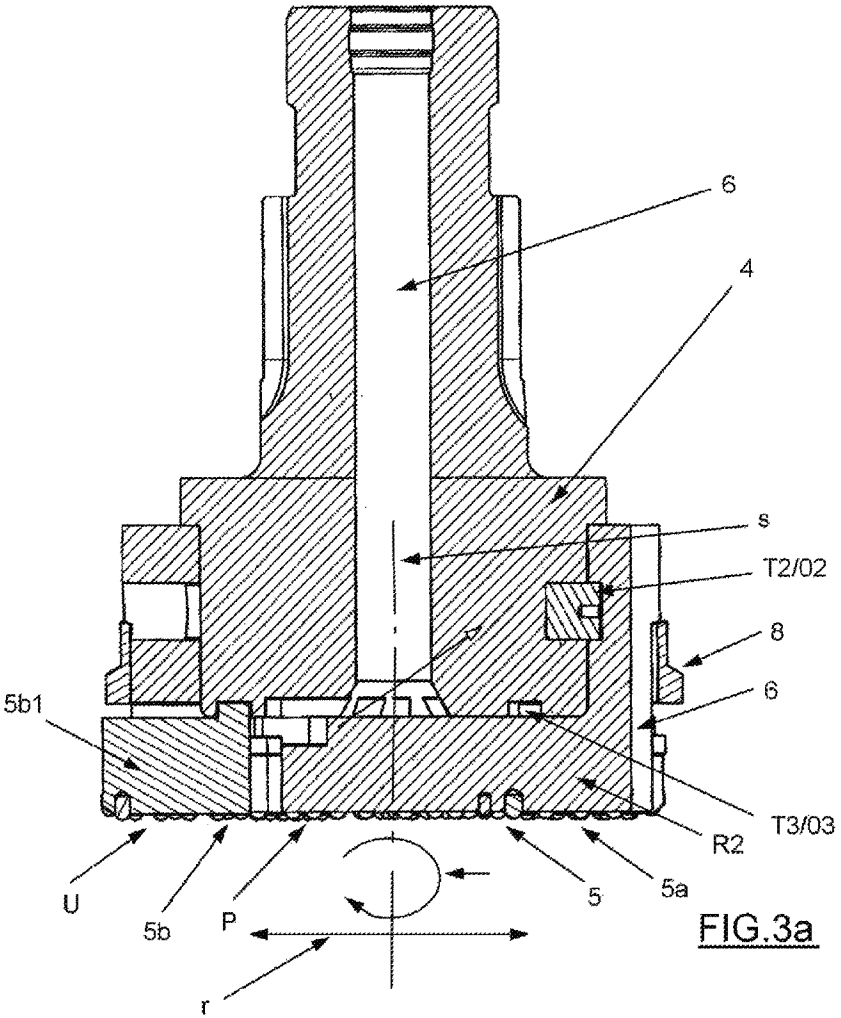
Figure 4A:
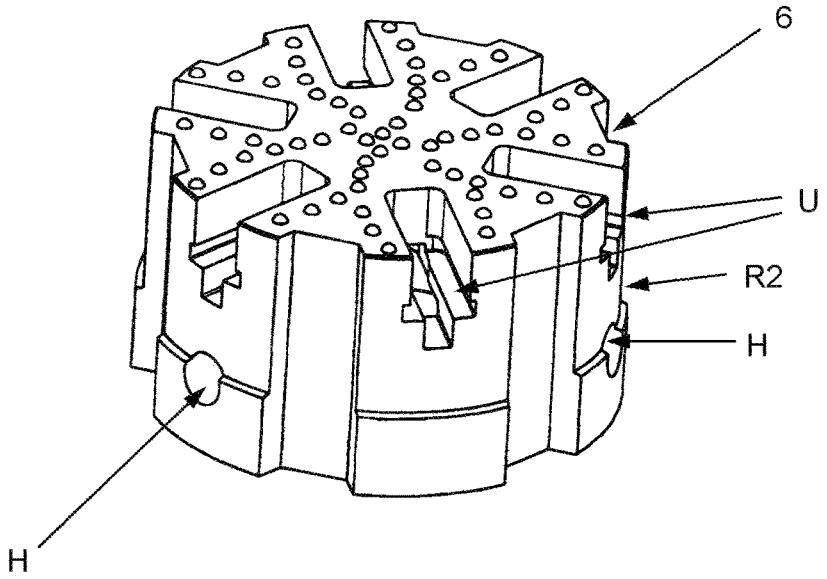
Figure 4B:
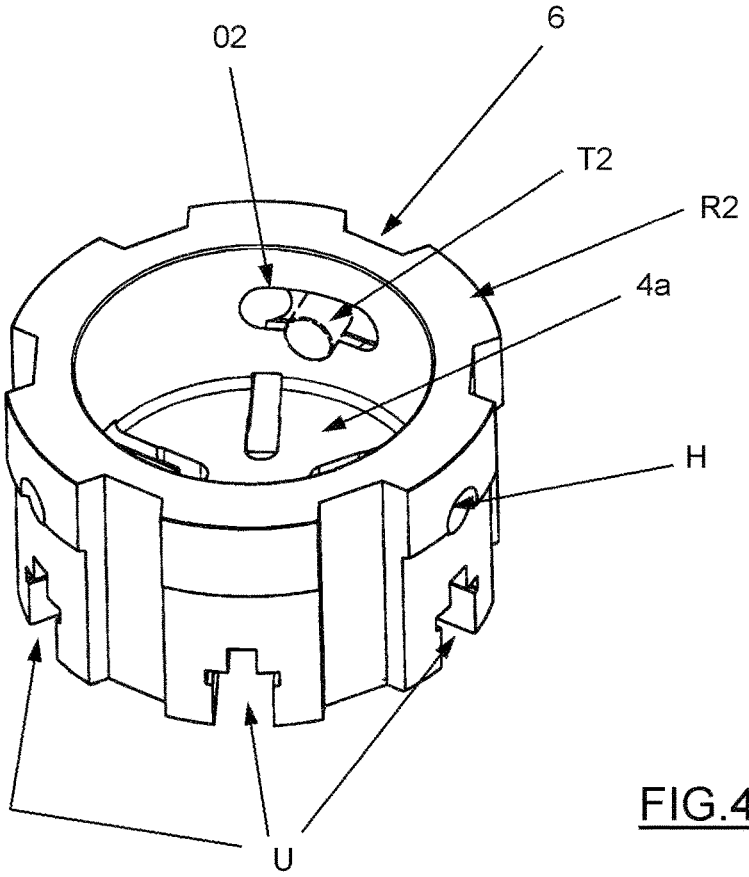

As an alternative embodiment with respect to the one explained above with reference to the advantageous embodiment shown particularly in FIGS. 3*a*, 3*b*, the first drill bit arrangement 5*a* is arranged in an intermediate frame R2, which is coupled with the guide 4 to be movable with a restricted rotational movement in a crosswise plane x, such as by a pin/guide groove arrangement T2/02 or a like that manifests itself in FIGS. 3*a* and 4*b*. The above manifests itself in FIG. 4*b*, in which the intermediate frame R2 is shown from behind, according to which in the hole H in the intermediate frame R2 is fitted a pin T2 that moves in an elongated guide groove 02 in the guide 4.

In this embodiment, the bit pieces 5*b*1 of the second drill bit arrangement that are movable in the crosswise plane x, as shown in FIG. 3*b* that is essentially perpendicular to the longitudinal direction s of the drilling device, are further advantageously coupled with slide grooves U, such as so called dovetail or T-grooves, in the intermediate frame R2 that comprises the drilling organs 10 of the first drill bit arrangement 5*a*, which grooves hold the bit pieces also axially s (which principle applies naturally also to the bit pieces of the embodiment according to FIGS. 1*a*, 1*b*).

As a further advantageous embodiment of the drilling device according to FIGS. 3*a*, 3*b*, the movement of the drill bits 5*b*; 5*b*1 of the second drill bit arrangement in the radial direction r are arranged by a movement mechanism between the guide 4 and the bit pieces 5*b*1.

Figure 5B:
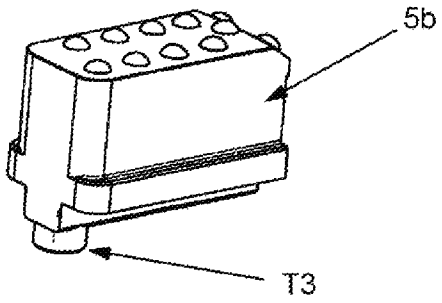
Figure 5A:
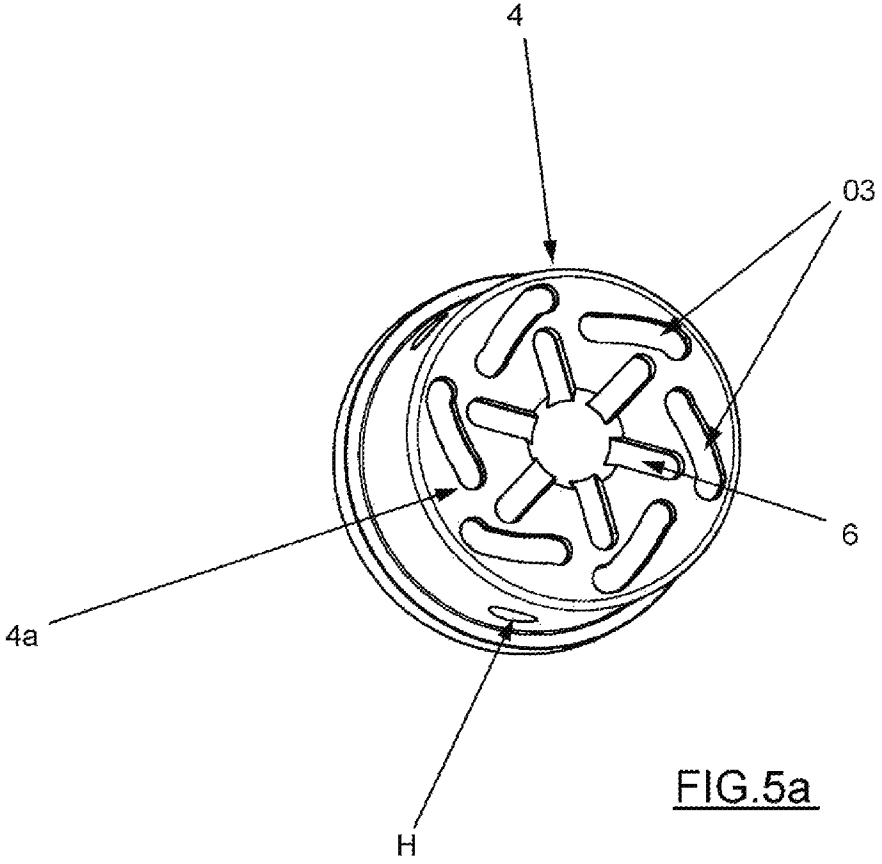

The movement mechanism in question is arranged by a mutual pin/glide groove arrangement T3/03 between an end surface 4*a* of the guide 4 and back surfaces of the bit pieces 5*b*1 or in a corresponding manner, wherein with reference particularly to FIGS. 5*a* and 5*b*, the movement mechanism has been carried out in this case by guide grooves 03 at the end surface of the guide 4, which depending on the rotating direction of the guide 4 transmit the bit pieces' 5*b*1 movement in radial direction in the slide grooves U in cooperation with pins T3 in the bit pieces. On the end surface 4*a* of the guide there has also been arranged flow ways 6 for leading of the flushing medium, being brought centrically, to the drilling device's drilling surface P in radial direction, on the outer surface of the guide guided by the end surfaces of the bit pieces and through the slide grooves U in the intermediate frame R2.

It is clear that the invention is not limited to those embodiments, being presented or described above, but instead it can be modified significantly within the basic idea.

It is thus possible e.g. to use on the drilling surfaces of the drilling device more frame parts than shown in the drawings or to exploit the embodiments shown in FIGS. 1*a*, 1*b* and 3*a*, 3*b* in a "mixed" manner one way or another e.g. by using wider or narrower bit pieces. Correspondingly in connection with the end of the casing part there is not necessarily a need to use a separate casing shoe, but instead the corresponding arrangements can be formed e.g. with arrangements fixed on the outer and/or internal surfaces of the end of the casing part. By arranging the flushing flows according to the principles shown in the drawings an efficient flow of the flushing medium into the spaces that will be left open between the drilling parts has been tried to achieve, so that material may not get collected therein. This influence may be made more efficient by using a more abundant flushing flow channel system than presented above or by carrying out the flushing flow channel system to operate by so called reverse flow. In the drilling device according to the invention it is possible to exploit parts manufactured by utilizing most heterogeneous manufacturing techniques by using customary used materials.

The invention claimed is:

1. A drilling device that is meant to be used in a down-the-hole drilling apparatus for drilling a hole by using the drilling device and a casing part and a hammering device when needed, the drilling device comprising:

in a drilling head thereof a guide, a drilling member, and a flushing arrangement configured to flush drilling waste being generated, wherein the drilling member comprises a first drill bit assembly and a second drill bit assembly, whereby the drill bit assemblies comprise drilling organs, wherein the second drill bit assembly is arranged to be expanded for drilling a greater hole than a free cross-sectional surface area of an end of the casing part and to be reduced to a smaller size than the free cross-sectional surface area of the end of the casing part in order to make possible removal of the drilling device from a hole that has been drilled and for leaving the casing part in the drilled hole by removing the drilling device through the casing part, whereby the second drill bit assembly comprises at least two bit pieces that are movable in a radial direction on a drilling surface of the drilling member, and the drilling organs are arranged in the bit pieces of the second drill bit assembly when viewed in a longitudinal direction of the drilling device on a front surface thereof, wherein the bit pieces of the second drill bit assembly are arranged, for expanding/reducing of the second drill bit assembly utilizing the guide, movable in slide grooves that pass in the radial direction on the drilling surface of the drilling member for expanding the second drill bit assembly by moving the bit pieces of the second drill bit assembly in the radial direction outwards in the slide grooves, by rotating the guide in a first direction in a drilling direction, and for reducing the second drill bit assembly by moving the bit pieces of the second drill bit assembly in the radial direction inwards in the slide grooves, by rotating the guide in a second direction opposite the first direction, wherein the slide grooves of the bit pieces of the second drill bit assembly are arranged either in an auxiliary frame, wherein the first drill bit assembly is arranged in an immovable manner relative to the guide, or in an intermediate frame, wherein the first drill bit assembly is in connection therewith, the frame being coupled with the guide rotatively in a restricted manner in a crosswise plane.

2. The drilling device according to claim 1, wherein the drilling organs of the first drill bit assembly are arranged in a built-in manner in the guide, and are arranged at an outer end of the guide operating as the drilling surface.

3. The drilling device according to claim 1, wherein the auxiliary frame is rotates via a pin/guide groove arrangement.

4. The drilling device according to claim 1, further comprising: a movement mechanism of the bit pieces of the second drill bit assembly, moving in the radial direction in a crosswise plane to the longitudinal direction of the drilling device, is arranged depending on the rotation direction of the guide to push the guide in the longitudinal direction out from the casing part or to pull the same inside the casing part, whereby the movements of the bit pieces of the second drill assembly in the radial direction are arranged by influence of a guide surface arrangement, being in connection with the bit pieces of the second drill assembly and both the casing part and an end of the guide.

5. The drilling device according to claim 1, wherein movement of the guide in the longitudinal direction, while being rotated in an opposite direction with respect to the drilling rotation direction, is arranged by a thread coupling carried out by a pin/guide groove arrangement between the guide and the auxiliary frame.

6. The drilling device according to claim 1, wherein the intermediate frame rotates via a pin/guide groove arrangement.

7. The drilling device according to claim 6, wherein the bit pieces of the second drill bit assembly that are movable in the crosswise plane, being perpendicular to the longitudinal direction of the drilling device, are coupled with slide grooves in the intermediate frame that comprises the drilling organs of the first drill bit assembly.

8. The drilling device according to claim 6, the movement of the drill bits of the second drill bit assembly in the radial direction are arranged by a movement mechanism between the guide and the bit pieces.

9. The drilling device according to claim 8, wherein the movement mechanism is arranged by a mutual pin/glide groove arrangement between an end surface of the guide and back surfaces of the bit pieces.

10. The drilling device according to claim 1, wherein the drilling organs comprise an integrated drilling part, separate drilling pieces, or bits.

* * * * *